US007887388B2

(12) United States Patent
Holsten et al.

(10) Patent No.: US 7,887,388 B2
(45) Date of Patent: Feb. 15, 2011

(54) MANUAL AIR PUMP POWERED CAR RACING GAME

(76) Inventors: William A. Holsten, 16 Twin Oaks Rd., Parsippany, NJ (US) 07054; Janet Holsten, 16 Twin Oaks Rd., Parsippany, NJ (US) 07054

( * ) Notice: Subject to any disclaimer, the term of this patent is extended or adjusted under 35 U.S.C. 154(b) by 37 days.

(21) Appl. No.: 12/269,805

(22) Filed: Nov. 12, 2008

(65) Prior Publication Data

US 2009/0124167 A1 May 14, 2009

Related U.S. Application Data

(60) Provisional application No. 61/002,891, filed on Nov. 13, 2007.

(51) Int. Cl.
*A63F 9/14* (2006.01)

(52) U.S. Cl. ..... 446/429; 446/64; 446/430

(58) Field of Classification Search ..... 446/178–180, 446/199, 429, 430, 64, 435, 438, 446, 448; 273/108, 129
See application file for complete search history.

(56) References Cited

U.S. PATENT DOCUMENTS 3,936,053 A * 2/1976 Goldfarb et al. ..... 273/108
4,159,705 A * 7/1979 Jacoby ..... 124/63
4,209,935 A * 7/1980 Parker ..... 463/64
4,229,005 A * 10/1980 Barlow et al. ..... 463/64
4,897,065 A * 1/1990 Fertig et al. ..... 446/63
5,154,657 A * 10/1992 Wildman et al. ..... 446/211
5,653,216 A * 8/1997 Johnson ..... 124/69
7,160,171 B1 * 1/2007 Rehkemper et al. ..... 446/429
7,285,035 B1 * 10/2007 Tullis ..... 446/444
2004/0198168 A1 * 10/2004 Delgado ..... 446/444

* cited by examiner

*Primary Examiner*—Nini Legesse
(74) *Attorney, Agent, or Firm*—Edwin Tarver; Lauson & Tarver

(57) ABSTRACT

A pneumatic manual air pump powered car racing game presents a housing which serves as a powering station from which a race car is propelled down a race track. A pump handle is manipulated to pressurize an air chamber with substantial pressure, which is released to discharge the race car from its starting position at the housing end of the race track to the distal end of the race track. A race car's starting position refers to the releasably yet hermetically sealed male to female junction between the housing and race car. A signal is comprised at the distal end of the race track to indicate a conclusive race by a triggering device, including a mechanical or electronic device for alerting a player that the race car has reached the end of the track. A race is arranged by two or more users with multiple devices by setting up a parallel series of race tracks.

9 Claims, 3 Drawing Sheets

MANUAL AIR PUMP POWERED CAR RACING GAME

CROSS-REFERENCE TO RELATED APPLICATION

This application claims the benefit of the priority date of provisional application No. 61/002,891, filed on Nov. 13, 2007.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Pneumatically driven toy racing apparatuses are known in the art. U.S. Pat. No. 7,160,171 to Rehkemper et al. discloses a pneumatic pump in combination with a pneumatic toy vehicle powered by a refillable compressed chamber. The improvement of the pump is defined by having a pipe that has an aperture to exhaust air being pumped therefrom. The pump further includes a means for launching the vehicle from the pump. The toy vehicle includes a pneumatic motor that when activated utilizes air in the chamber to propel the vehicle and activation of the motor is achieved by moving the vehicle. The vehicle includes an air inlet valve sized to securely engage the pipe of the pump such that movement of the vehicle during filling of the chamber is prevented. When securely engaged by the pipe, the vehicle is positioned against the launching means. A user operating the launching means pushes the vehicle, which activates the motor, such that the vehicle launches away from the pump.

SUMMARY

A pneumatic manual air pump powered car racing game device is shown and described. The device comprises a housing, serving as a powering station from which a race car is propelled down a track. The race car is initially connected to the end of an air tube extending from the housing, which holds the car in a starting position, hermetically coupled to the end of the air tube. A user manipulates a pump handle extending from the housing, causing a manually operated pump inside the housing to fill a chamber with pressurized air. The air tube is connected to the chamber, with an air release valve disposed along its length, and the release valve is connected to a triggering mechanism. When the triggering mechanism is activated, air from the chamber travels through the air tube, and out the terminal end of the air tube.

The terminal end of the air tube fits into a bore in the back of the race car, and comprises means of retaining the race car against the terminal end of the air tube in a hermetically sealed configuration, so that when air is released, substantial pressure can build up behind the race car before the car is discharged from the terminal end of the air tube.

When the race car is expelled from its position associated with the housing, pump and air tube apparatus, it travels rapidly down the track away from the housing and toward the opposite end of the race track. At the opposite end of the race track, a means of determining a winner is disposed. In one embodiment an electronic mechanism senses the arrival of the race car and alerts the players. In various preferred embodiments, the triggering means triggers a signal may comprise a flag that indicates the finish of the race, or another mechanical or electronic means.

The race car comprises a chassis with wheels and a body representing a car. At the rear of the car is a bore that fits hermetically over the terminal end of the air tube. In this manner, the terminal end of the air tube and bore of the race car comprise a male-to-female coupling.

In order to use the device, at least two or more devices are arranged side by side to form a series of pump housings and a series of parallel race tracks. To begin a race, the contestants attach race cars to the terminal ends of the air tubes, and take a position adjacent to the pump handles. A predetermined time is established, during which the contestants pump air into the pressure chambers in the housings. At the conclusion of this time, the contestants activate the triggers on the housing, causing the relief valves to open and propel the race cars down the track to the finish line. When a car reaches the finish line, an indicator indicates that the car has finished the race. The first car to activate the indicator is declared the winner.

DESCRIPTION

Figure 1:
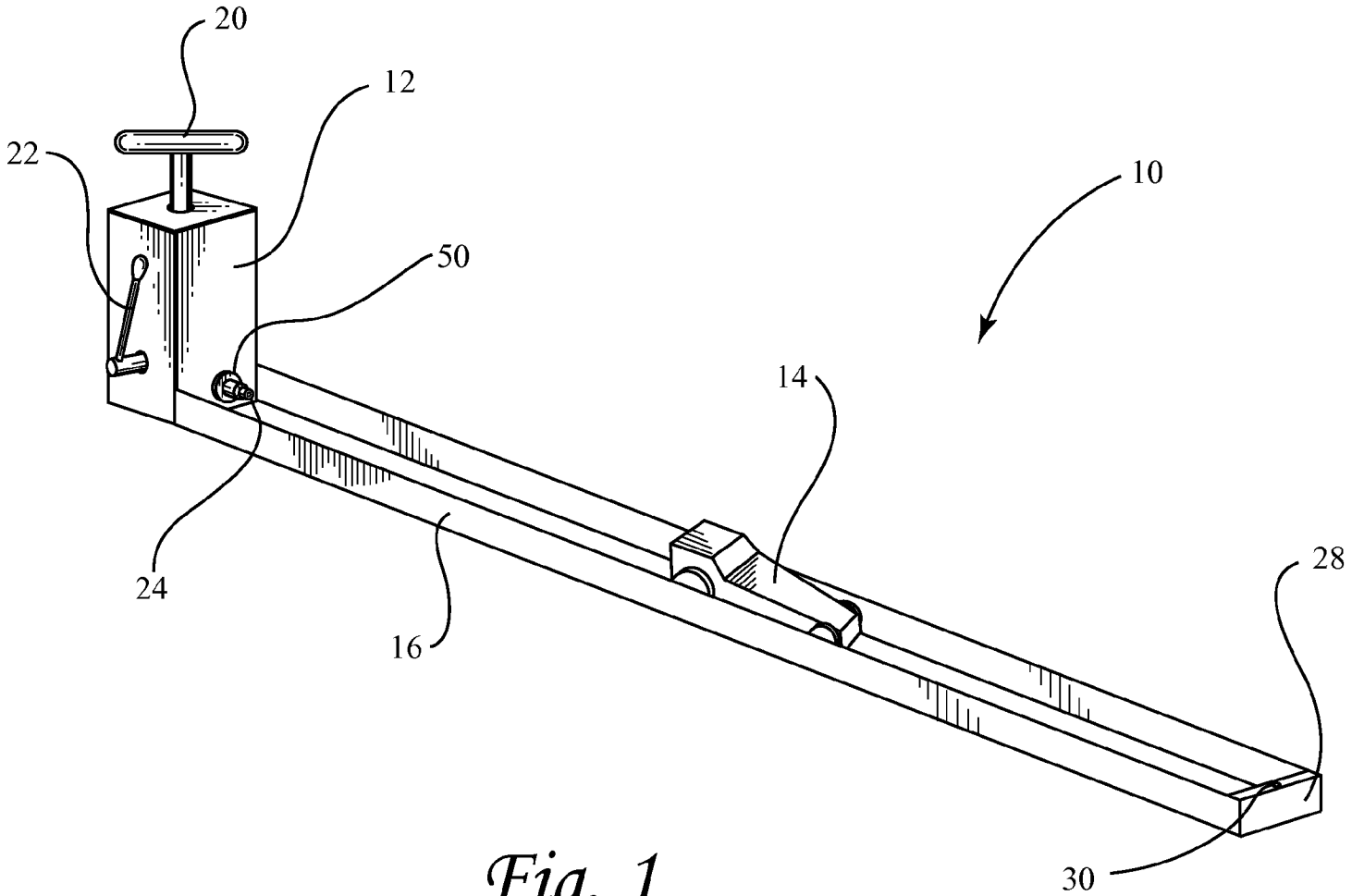
FIG. 1 is a perspective view of the air pump powered car racing game, showing the housing and track.

Referring to FIG. 1, a pneumatically air powered pump car racing game device is shown and described. In one preferred embodiment, the device 10 comprises a housing 12, which serves as a powering station for propelling a race car 14 or other object down the track 16. The race car 14 is initially connected to the end of an air tube 24 and sealing means 50, which holds it in position.

In order to use the invention, a user manipulates the pump handle 20, causing a manually operated pump (not shown in this figure) inside the housing 12 to fill a chamber (not shown in this figure) with pressurized air. The pressurized air remains in the chamber until an air release valve is triggered using a triggering mechanism 22. When the triggering mechanism 22 is activated, air from the chamber travels through an air tube connected to the chamber, through the valve and out the terminal end 24 of the air tube.

The terminal end 24 of the air tube fits into a bore at the rear of the race car 14. In one preferred embodiment, the terminal end 24 of the air tube fits into a bore in the back of the race car 14 and comprises means of retaining the race car 14 against the terminal end 24 of the air tube in a hermetically sealed configuration, so that when air is released, substantial pressure can build up behind the race car 14 before it discharges from the terminal end 24 of the air tube.

When the race car 14 is expelled from its position associated with the housing 12, it travels at a velocity down the track 16 away from the housing 12 and toward the opposite end of the race track 16. At the opposite end of the race track 16, a triggering means 28 indicates when a race car 14 reaches the end of the track 16. In one preferred embodiment, the triggering means 28 triggers a signaling means 30, which indicates that the race car 14 has reached the end of the track 16.

In various preferred embodiments, a signaling means is contemplated as any mechanical or electrical means for associating the activation of the triggering means 28 with the race car 14 reaching the end of the track 16.

Figure 2:
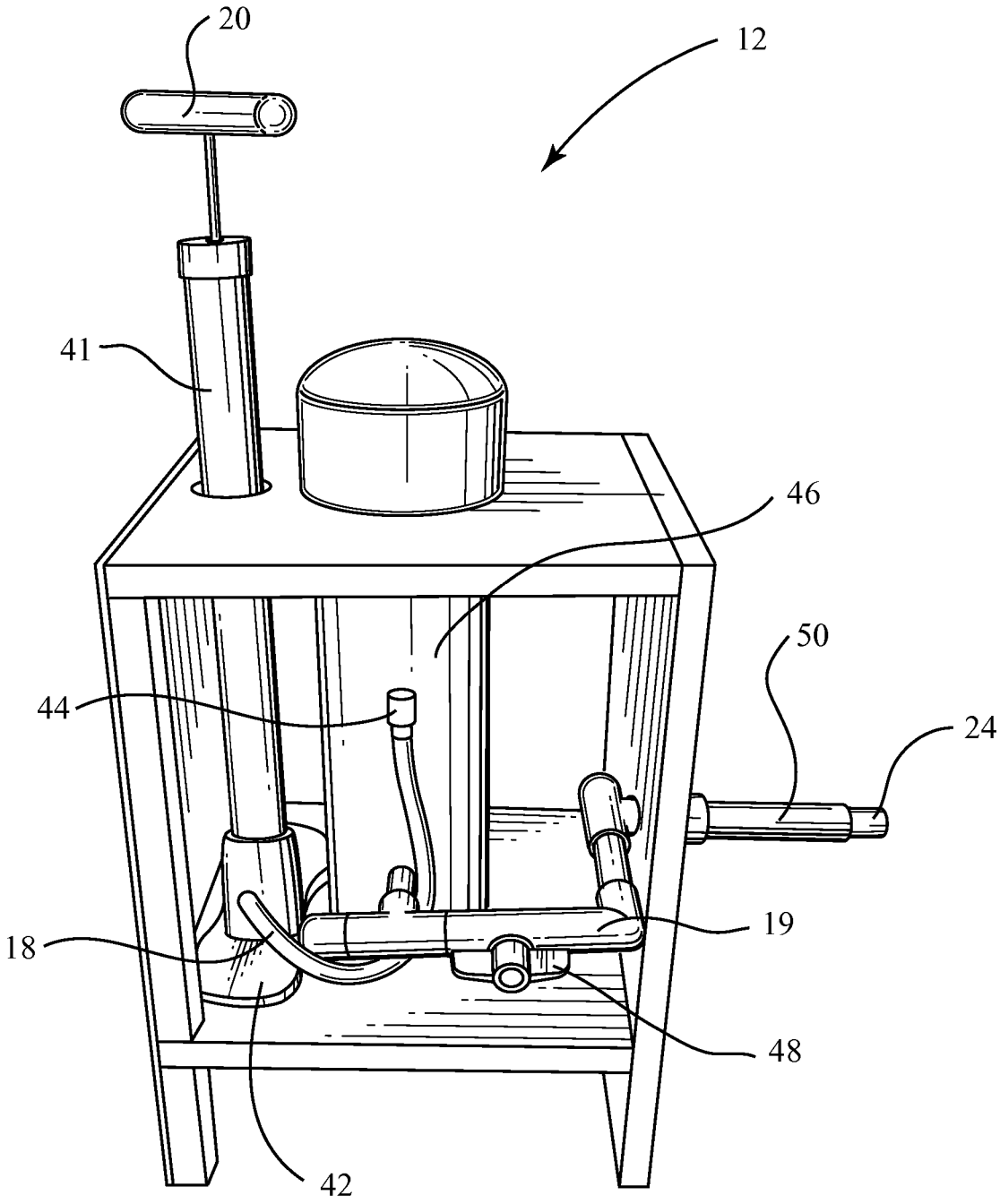
FIG. 2 is a perspective cut-away side view of the housing.

Referring to FIG. 2, a detail of the housing 12 is shown and described. The housing 12 comprises a substantially box shaped unit. Inside the unit, a pump 41 is anchored, with the pump handle 20 extending out of the housing 12 for access by a user. The pump 41 is anchored to the housing 12 using anchoring means 42, and connected via a hose 18 and one way valve 44 to a pressure chamber 46 for containing pressurized air. An air tube 19 with two ends is connected to the pressure chamber 46, and extends out of the housing 12. A pressure valve 48 is disposed along the length of the air tube 19, to hold air in the pressure chamber 46 while the pump 41 is actuated.

Once the pressure chamber 46 is filled, the release valve 48 is triggered by a player. In this manner, the triggering of multiple individual devices can be coordinated. As the valve 48 opens, pressurized air from the pressure chamber 46 travels through the air tube 19, and exits through the terminal end 24 of the air tube 19, extending beyond the housing 12. In a preferred embodiment, a hermetic sealing means 50 is disposed on the terminal end 24 of the air tube 18 and serves to hold a race car against the housing 12 until sufficient pressure builds up to expel the car with force.

Figure 3:
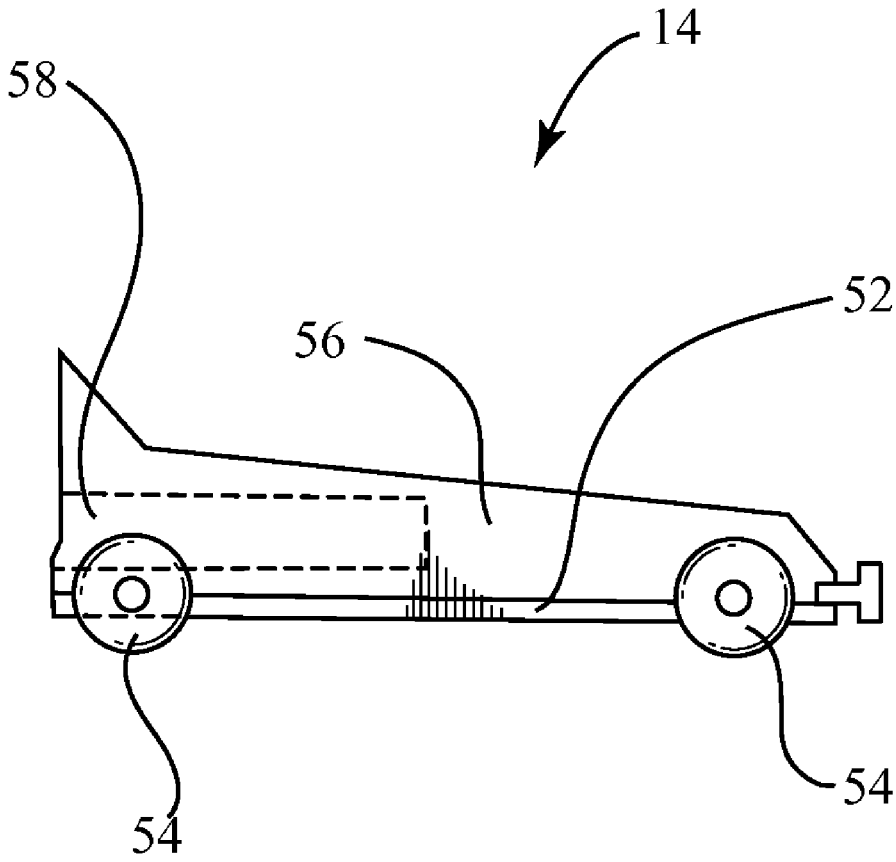
FIG. 3 is a side view of the race car

Referring to FIG. 3, a cut away view of the race car is shown and described. The race car 14 comprises a chassis 52 with wheels 54 and a body 56 representing a car, in a preferred embodiment, a drag-race car. At the rear of the car an attachment means 58 is disposed that corresponds to the terminal end of the air tube 24. In a preferred embodiment, the attachment means 58 is a bore that fits hermetically and releaseably over the terminal end of the air tube 24. In this manner, the terminal end of the air tube 24 and bore 58 of the race car 14 comprise a male to female connection.

In order to employ the device of the present invention, multiple devices are arranged side by side to form a series of pump housings and a series of parallel race tracks. To engage in a race, the contestants attach race cars to the terminal ends of the air tubes, and take their positions adjacent the pump handles. A predetermined time is established, during which the contestants pump air into the pressure chambers in the housings. At the conclusion of the predetermined time, the contestants activate the triggers on the housing, causing the relief valves to open and causing the race cars to be propelled down the track to each car's respective opposite track end. In one preferred embodiment, when a car reaches the opposite end of its track 16, a mechanical or electronic indicating means is activated by a triggering means 30 and indicates that the car has reached the finish. The first car 14 to activate the indicating means at the finish line of its track 16 is declared the winner.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An improved pneumatically powered car racing game device comprising;

a. a manual air pump;

b. a pressure chamber connected to the pump;

c. an air supply connected to the chamber at a first end and having a second end connected to the proximal end of a track with a proximal and distal end, for moving air between the chamber and the proximal end of the track;

d. a valve disposed along the air supply capable of regulating the movement of air through the air supply;

e. a race car capable of releasably pneumatically sealing against the second end of the air supply, wherein when the valve opens, air traveling through the air supply from the pressure chamber to the race car, causes the car to disengage from the air supply and be propelled along the track until reaching a marker at the distal end of the track; wherein the pump, pressure chamber, air supply, and valve are contained in a housing; and wherein the distal end of the track comprises a signal activated when the car reaches the distal end.

2. The device of claim 1, wherein multiple devices are arranged in tandem to allow competitive racing.

3. The device of claim 1, wherein a junction at the second end of the air supply and race car comprises a female to male connection.

4. The device of claim 3, wherein the second end of the air supply comprises the male side of the junction, and the car comprises the female side of the junction.

5. The device of claim 4, wherein the female portion of the junction is disposed at the rear of the car, and comprises a bore, and wherein the male portion of the air supply comprises a tube.

6. The device of claim 5, wherein a means for releasably yet hermetically sealing the junction is provided.

7. The device of claim 1, wherein the signal provides a visual cue indicating that a car has reached the distal end of the track.

8. The device of claim 7, wherein the signal comprises a mechanical or electronic indicator to indicate that a car has reached the distal end of the track.

9. An improved pneumatically powered car racing game device comprising;

a. a housing containing a manual air pump, a pressure chamber, and an air tube with two ends and a relief valve, wherein the pumping handle and control for the relief valve are disposed on the outside of the housing and accessible by a user, and wherein the first end of the air tube is connected to the pressure chamber, and the second end of the air tube exits the housing, and the tube is connected to a proximal end of a race track;

b. the race track having a proximal end adjacent to the housing and a distal end away from the housing, wherein the distal end comprises a finish line and an indicator that is activated when a race car reaches the finish line; and c. a race car, wherein the race car is capable of releasably yet hermitically being sealed at the second end of the air tube, and wherein the relief valve allows compressed air traveling from the pressure chamber, through the air tube, to propel the race car from the proximal to the distal end of the track.

* * * * *